US006038817A

United States Patent [19]

Scheck et al.

[11] Patent Number: 6,038,817

[45] Date of Patent: Mar. 21, 2000

[54] BOWDEN TUBE WINDOW WINDER WITH COMPENSATION FOR CABLE LENGTH

[75] Inventors: Georg Scheck, Weitraumsdorf; Uwe Klippert, Oberaula; Carsten Brandt, Weidach, all of Germany

[73] Assignee: Brose Fahrzeugteile GmbH & Co. KG, Coburg, Coburg, Germany

[21] Appl. No.: 09/068,713

[22] PCT Filed: Nov. 28, 1996

[86] PCT No.: PCT/DE96/02329

§ 371 Date: May 14, 1998

§ 102(e) Date: May 14, 1998

[87] PCT Pub. No.: WO97/20126

PCT Pub. Date: Jun. 5, 1997

[30] Foreign Application Priority Data

Nov. 30, 1995 [DE] Germany ..... 195 44 630

[51] Int. Cl.[7] ..... E05F 11/48

[52] U.S. Cl. ..... 49/352; 74/505; 49/502

[58] Field of Search ..... 49/352, 502, 348, 49/349; 74/502.6, 500.5, 505, 501.5

[56] References Cited

U.S. PATENT DOCUMENTS 4,235,046 11/1980 Hess et al. ..... 49/352
4,662,236 5/1987 Kobayashi ..... 49/352 X

FOREIGN PATENT DOCUMENTS 0607589 7/1994 European Pat. Off. .
2750904 5/1979 Germany .

*Primary Examiner*—Daniel P. Stodola
*Assistant Examiner*—Hugh B. Thompson
*Attorney, Agent, or Firm*—Christie, Parker & Hale, LLP

[57] ABSTRACT

The invention relates to a Bowden tube window winder with compensation for cable length, which also compensates using simple means for a comparatively high level of cable elongation without excessive twisting of the cable loop. Said Bowden tube window winder is characterised in that a common locking member (10) is associated with the cable sockets and links the force of the two cable sockets (110) with the result that a movement to compensate for play of at least one cable socket can only occur when both cable sockets are substantially unloaded.

19 Claims, 9 Drawing Sheets

1
2
3
12
200
20
8
7
8
11
13
30
120

2
61b
6
610b
60
62
621a
61a
610a
621b
620b

BOWDEN TUBE WINDOW WINDER WITH COMPENSATION FOR CABLE LENGTH

FIELD OF THE INVENTION

The invention relates to a Bowden tube window regulator with cable length compensation that allows the compensation of comparatively large cable lengths without excessively tensioning the cable loop.

BACKGROUND OF THE INVENTION

From German Patent DE 38 29 922 C2, a Bowden tube window regulator is known having a closed cable loop which is guided over guide pulleys mounted at the ends of a guide rail. The adjusting force is produced by a drive unit with a cable drum whose housing has two parallel cable exits. As the cable drum turns, the cable is wound in one direction or the other over the cable drum, and thereby moves the slider which is connected to the cable loop and which on one side is in positive displaceable engagement with the guide rail and on the other is fixed on the window pane.

Separate cable sleeves are fitted on the ends of the parallel cable exits of the cable drum housing. The free ends of the cable sleeves have thickened ends in which the ends of the flexible Bowden tubes are fitted. On the other side, coil springs are supported between the thickened ends and the housing of the cable drum to hold the cable loop under tension. As the cable length increases, the displaceable cable sleeves are pushed somewhat more out of their guide in the cable drum housing which quasi amounts to an extension of the Bowden tube.

However, there is the drawback that the described cable length compensation has a relatively large reverse play since as a result of the change of rotary direction one time the coil spring of one cable exit and one time the coil spring of the other cable exit is compressed more or less depending on strain. This reverse play can indeed be reduced by using stronger springs but with the drawback of ever increasing friction in the Bowden system and the loss of efficiency of the drive system connected therewith. Furthermore the compensating path provided for compensating the cable must be set out in both cable sleeves.

From German Patent DE 27 50 904 A1, a Bowden tube window regulator of the type described above is known where the cable sleeves biased by a tension spring are supported by a lock acting against the tension force. For this, each cable sleeve supports saw tooth like elements in which a spring-like locking element can engage. The locking element prevents the tension spring from becoming compressed when the window regulator is operated (loaded). Thus a reverse play cannot occur. However there is the drawback that the device described also compensates those cable slacks which occur as a result of the tension of the window regulator in the unstressed area of the cable on the other cable exit. A cable slack of this kind corresponds to a non-genuine cable slack (play), and in the event of its compensation after relaxation of the window regulator leads to tensions remaining in the system. The degree of efficiency is thereby impaired and the wear on the adjustment device increases. Furthermore this tension leads to premature further cable extension whereby a particularly large compensation path has to be set out in the device for cable length compensation.

A further variation of this specification provides a displaceable or eccentrically mounted cable guide pulley at the end of the guide rail which with the support of a tension element with the appearance of cable slack is to carry out a corresponding displacement movement. Through a lock with keyed locking elements it is ensured that a resetting movement is ruled out when loading the window regulator. In addition to the disadvantages described above, setting movements of the cable guide pulleys cause a changed angular cable guide which lead in addition to friction and wear.

From European Patent 0 607 589 A1, an infinitely operating device is known for compensating cable extensions. The cable sleeves mounted displaceable in a base member engage with a spring-like clamping element which allows movement of the cable sleeve only in the direction of the tension spring and is supported on the base member.

The drawback with this device is in particular the high surface pressure between the clamping element and cable sleeve which is required for a safe operation, that is for a reliable prevention of a resetting movement of the cable sleeve. However, with the appearance of large forces in connection with high temperatures this can easily lead to damage to the plastic body of the cable sleeve and even to a failure of the compensating device.

SUMMARY OF THE INVENTION

The object of the invention is to provide a Bowden tube window regulator of the generic kind so that solely so-called genuine cable slacks are compensated and undesired tensions of the adjustment system are avoided.

Accordingly a force coupling is produced between the cable sleeves through a locking element which is common to both cable sleeves. This force coupling allows a compensating movement of one or both cable sleeves only when the two cable sleeves—and thus both cable sections leading to the cable drum—are substantially unloaded. As soon as the window regulator is operated, there results a strain on one or other cable section depending on the rotary direction of the drive (lifting or lowering of the window pane). Particularly in the stop positions of the window pane where the drive reaches its maximum torque, large strains on the window regulator system occur which are generally connected with a relatively large "apparent" cable slack in the non-loaded cable section. The compensation of a non-genuine cable slack of this kind is reliably prevented by the invention whereby unnecessary mechanical strains in the system and the disadvantages associated therewith are avoided.

So-called genuine cable slacks only exist in the unloaded state of the window regulator and their compensation does not lead to undesired strains.

According to the invention the compensation movement can only take place through one or two cable sleeves. In the last mentioned case, in addition to the force coupling, a synchronization of the compensation movements of the two cable sleeves also occurs whereby this need not take place absolutely 1:1, that is the cable sleeves can also be displaced over paths of different length.

For Bowden tube window regulators which have a parallel cable exit from the drive (cable drum housing), a preferred variation of the invention provides a one-piece base member in which two cable sleeves and a common stop face are integrated for the locking element. The locking—and thus stopping of a resetting movement—can take place stepwise, more particularly finely stepped, by using teeth elements and locking elements engaging therein. The teeth elements can hereby be arranged along the displacement path of the base member, thus parallel to the cable exits, on the base member itself or on the housing of the drive (of the cable drum housing) wherein the locking elements are located on each other body. The teeth preferably have a saw-tooth like shape. The associated locking elements should be formed as resilient tongues.

There is however also the possibility of an infinite compensation of the cable slack. To this end, a rotary mounted eccentric is used as locking element which is in connection with a pretensioned spring. This spring exerts on the eccentric a sufficiently large torque so that when cable slack appears the base member can be moved in the displacement direction. As a result of the self locking action of the device or security against return rotation, it is prevented that the base member can be turned back in the event of strain on the window regulator through the Bowden tube. Ideally the eccentric is mounted locally fixed with a spring preferably coil or spiral spring relative to the housing of the cable drum whilst the stop face associated with it is molded in one-piece in the material of the base member.

So that the cable can be easily fitted, each cable sleeve of the base member has a full-length slit extending in the cable direction and through which the cable can be fitted.

The invention can however also be used on Bowden tube window regulators with cable sleeves standing at an angle to each other. To this end a rotatable eccentric is used which has one above the other, that is along its rotary axis, two separate eccentrically aligned stop faces. Each of these eccentric stop faces is in connection with the stop face of one cable sleeve. This eccentric is also mounted locally fixed relative to the cable drum.

If an adjustment movement of the cable sleeves is required synchronized in a ratio of 1:1 then the two stop faces of the two-phased eccentric have the same contour and are turned relative to each other accurately about the angle which the cable sleeves include with each other. As soon as the contour of the eccentric stop faces deviate from each other and/or the angle included between same does not agree with the angle between the cable exits (cable sleeves), then a synchronous setting movement of the cable sleeves deviating from the ratio 1:1 takes place (compensating movement). That is the length of the setting path of the one cable sleeve differs from the length of the setting path of the other cable sleeve.

If a compensating movement is to take place through the displacement of only one cable sleeve then the contour of the eccentric section which enters into engagement with the other non-displaceable cable sleeve is to be formed circular and concentric with the eccentric axis. A rotary movement of the eccentric thus still leads only to displacement of one cable sleeve while the other cable sleeve serves only to maintain the force coupling.

The engagement of this cable sleeve with the concentric circular face of the eccentric should however be produced through teeth-like positive locking elements in order to be able to ensure at the same time the function of an anti-rotation lock.

With the design of the spring element which acts on the cable sleeves, directly or through the eccentric indirectly, in the displacement direction it should be taken into account that—depending on the design principle of the invention used (invention variation)—a maximum of twice the length of the cable compensating path is set opposite the displacement path. The compensation of any cable slack which may exist takes place as a rule with a reversal of the load direction of the window regulator. A part of the cable slack is then transported from the unloaded cable strand to the loaded cable strand so that for a short time span which is sufficient however to compensate the cable length, a cable slack adjoins both cable inlets of the cable compensating device which can be compensated. In the event that the spring element is sufficiently strong to move one part of the cable slack from one cable exit to the other, that is to draw round the cable, a cable length adjustment can likewise take place.

BRIEF DESCRIPTION OF THE DRAWINGS

The invention will now be explained in further detail with reference to the embodiments and the drawings illustrated in which.

DETAILED DESCRIPTION OF THE INVENTION

Figure 1A:
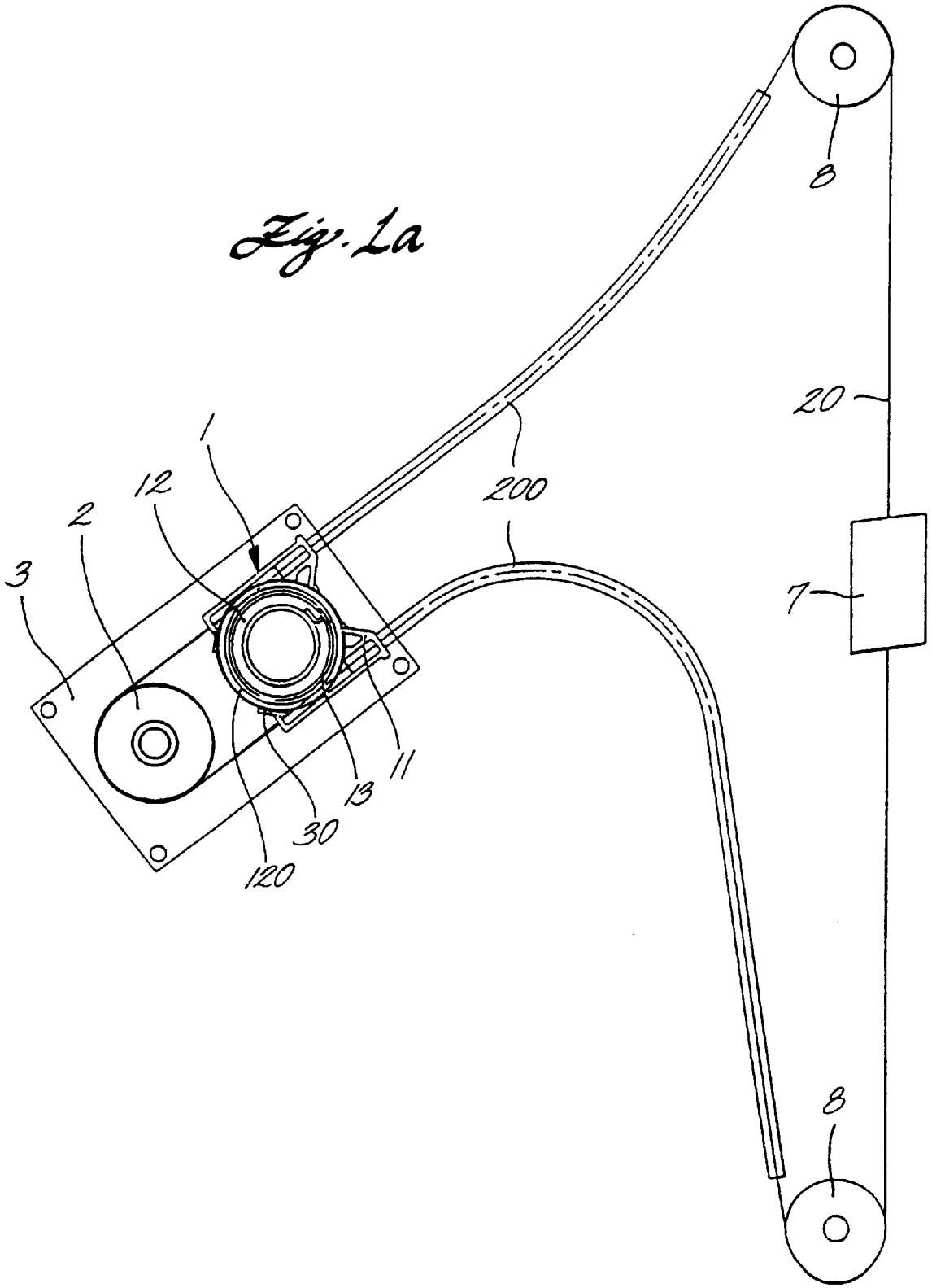
FIG. 1*a* is a diagrammatic illustration of the side view of a single-strand Bowden tube window regulator with a device for the cable length compensation by using an infinitely acting eccentric adjustment.
Figure 1B:
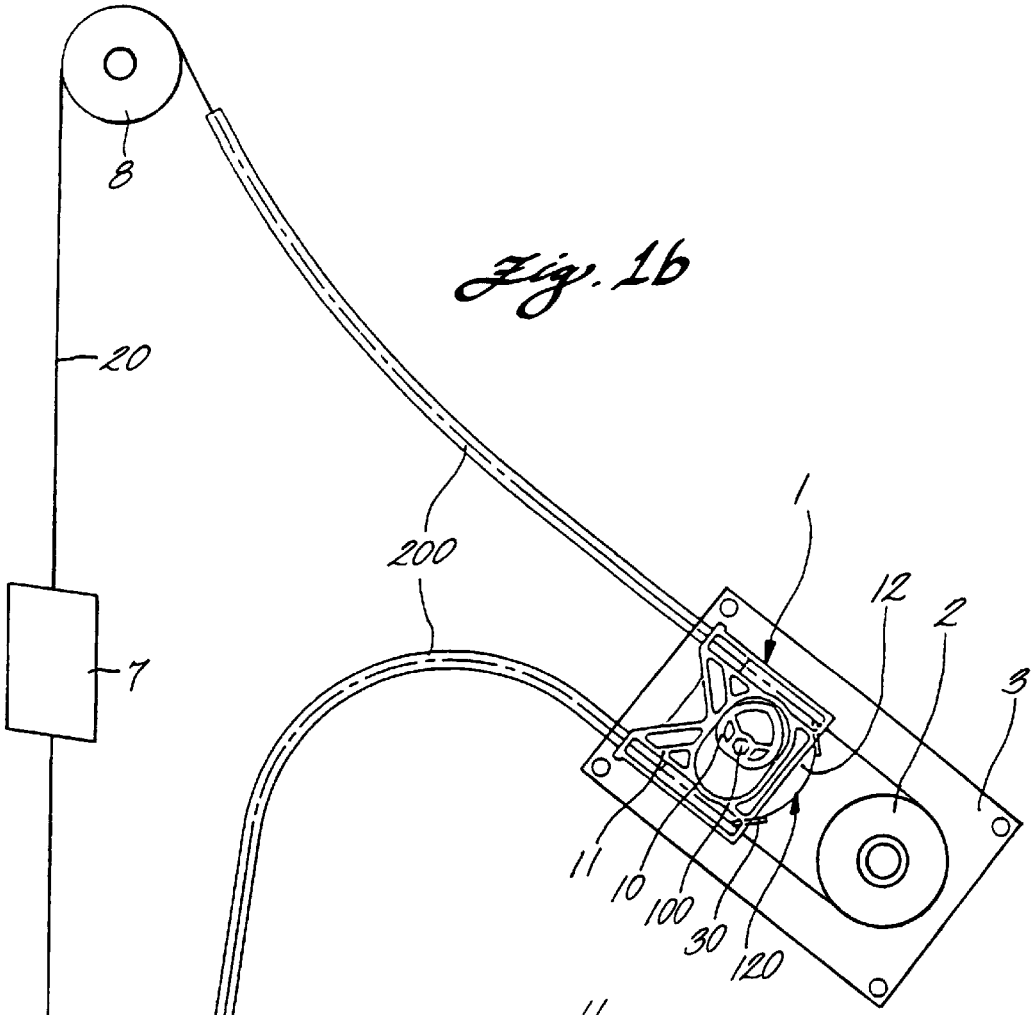
FIG. 1*b* like FIG. 1*a*, but with a 180°-turned view (back view)

FIGS. 1*a* and 1*b* show the front and rear view of the arrangement of an embodiment of the cable length compensating device 1 according to the invention on a base plate 3 to be fixed in the vehicle door and which also supports the drive (not shown), such as a hand crank drive or a motor drive with a cable drum 2. The invention will be explained using the example of a single-strand Bowden tube window regulator whose closed cable loop 20 is guided over two cable guide pulleys 8 and is driven by the cable drum 2. An entrainment member 7 is in fixed connection with the cable section between the cable guide pulleys 8 and the window pane is in turn fixed on the entrainment member. Generally the entrainment member 7 is guided by a so-called guide rail (not shown) which extends along the displacement path of the window pane. The Bowden tubes 200 allow a cable guide adapted substantially to the concrete conditions in the vehicle door. Its ends are on one side inserted in parallel cable exits of the cable sleeves 110 (see also FIGS. 1*d* to 1*f*) and on the other side are supported on stop faces (not shown) of the upper and lower cable guide in the area of the cable guide pulleys 8.

Figure 1C:
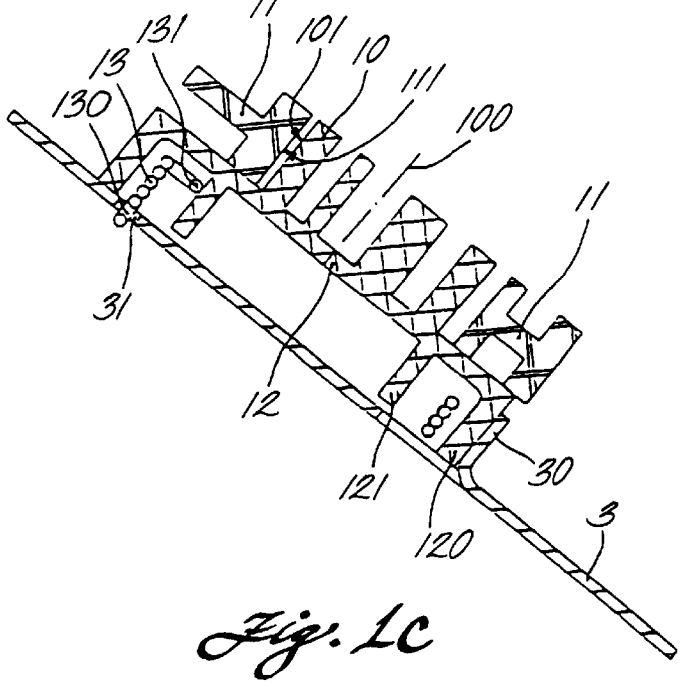
FIG. 1*c* is a sectional view through the base plate of the drive and cable length compensating device.

The cable 20 runs open between the cable drum 2 and cable length compensating device 1 and is in direct connection, that is, it is not guided in Bowden tubes 200. As can be seen in the sectional view of FIG. 1*c*, the cable length compensating device 1 consists substantially of three parts: a rotatable base member 12 which is in direct connection with the base plate 3, a spring 13 which exerts a torque on the rotatable base member 12, and a displaceable base member 11 which is mounted on the rotatable base member 12 displaceable in the opposite direction to the supporting forces of the Bowden tubes 200 on the cable length compensating device 1.

The rotatable base member 12 consists substantially of an outer support ring 120 which supports the supporting forces of the Bowden tubes 200 through a support element 30 of the base plate 3 which is formed as a material deformation, an inner supporting ring 121 on which the spring 13 hung in the hole 31 engages, and an eccentric 10 molded on the opposite side and engaging in the opening of the displaceable base member 11. To ensure simple fitting of the device, the parallel aligned cable sleeves 110 have full-length lateral longitudinal slits 112 through which the cable 20 is guided.

Figure 1D:
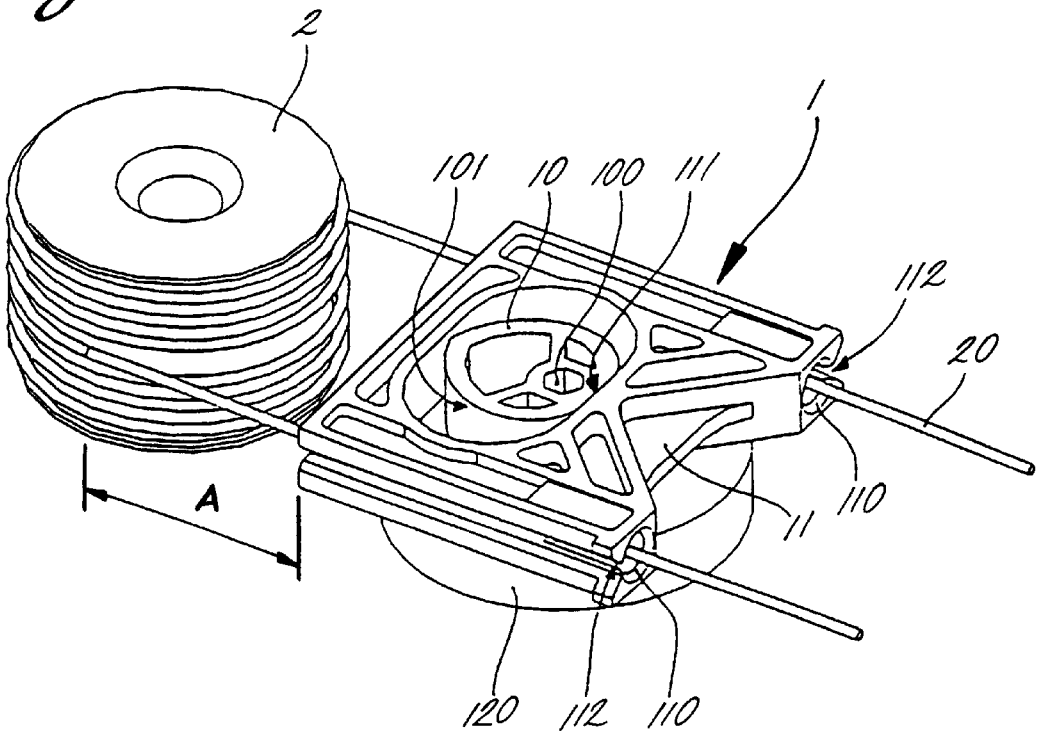
FIG. 1*d* is a perspective view of the cable length compensating device with cable drum prior to a compensating movement.

FIG. 1*d* clearly shows the details of the cable length compensating device 1. The eccentric 10 is located in a position in which its rotary axis 100 occupies the smallest possible distance from the stop face 111 of the displaceable base member 11. The cable length compensating device 1 thereby has a distance A from the rotary axis of the cable drum 2. When a sufficiently large supporting force of the Bowden tubes 200 adjoins the cable inlets of the cable sleeves 110 this position is maintained. A displacement of the base member 11 through the torque-biased eccentric 10 will also not then take place if the said supporting force is only applied by one of the two Bowden tubes 200, for example with a large strain on the window regulator on the drive or driven side. The so-called "non-genuine" cable slack thereby arising in the unloaded cable strand is thus not compensated and can thus also not lead to undesired tensions in the cable window system.

Figure 1E:
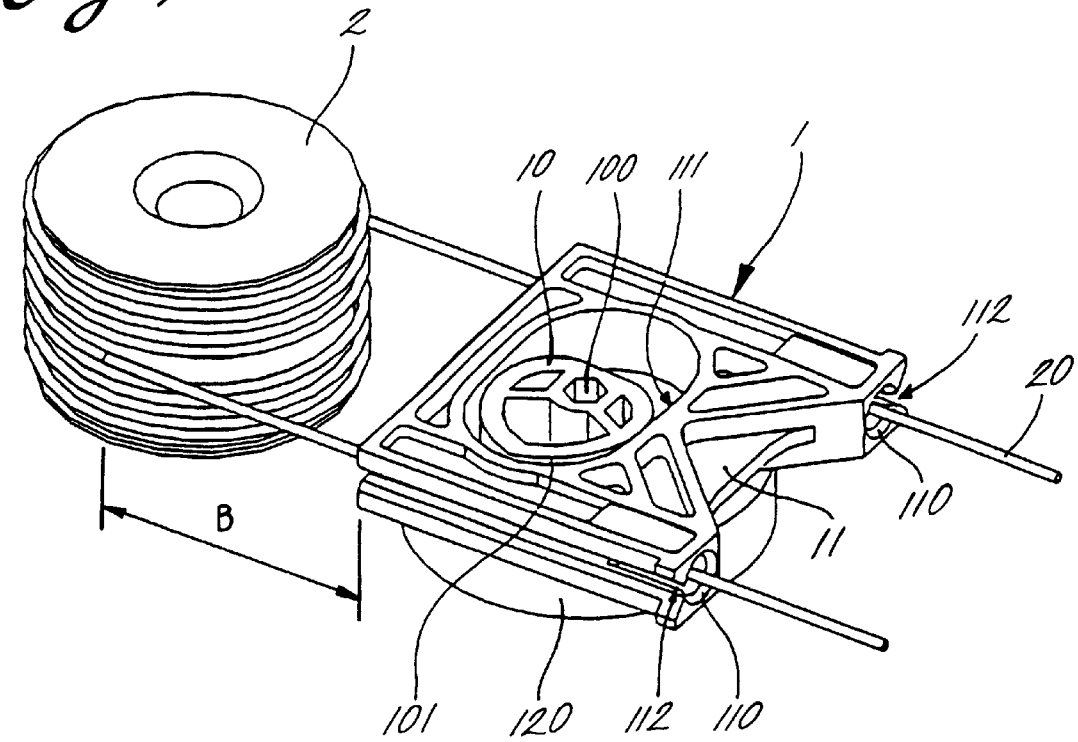
FIG. 1*e* like FIG. 1*d*, but after a compensating movement.

If, however, the Bowden supporting force acting on the displaceable base member 11 is less than the force coming from the stop face 101 of the eccentric 10 and acting on the stop face 111 and directed parallel to the cable exit, then a (genuine) cable slack exists which is compensated by a compensating movement of the displaceable base member 11. It thereby results in rotation of the rotatable base member 11 which leads to a changed position of the eccentric 10, as shown in FIG. 1*e*. Thus an increase in the distance between the rotary axis 100 and top face 111 occurs which corresponds exactly to the increase in distance (difference between distance B and distance A) between the cable drum 2 and base member 11. The distance of the rotatable base member 12 in relation to the cable drum 2 does not however change. Its position remains fixed through the supporting elements 30 against which the outer ring 120 rests.

Since a force coupling exists between the support spots of the Bowden tubes 200 on the base member 11, displacement of the base member 11, and thus a cable length compensation, can practically only take place with an unstressed window regulator. Its displacement path is always half as big as the compensated cable slack; the device is thus particularly suitable for cable window regulators where a relatively large cable lengthening is anticipated over the period of use.

Figure 1F:
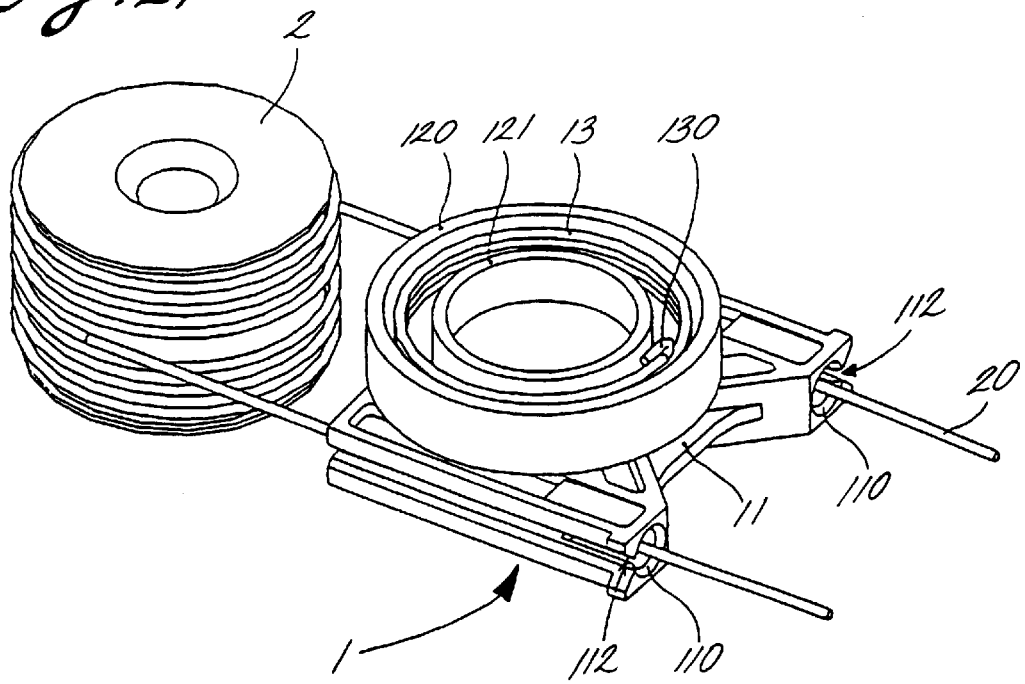
FIG. 1*f* is a reverse view of the cable length compensating device of FIG. 1*d;*

FIG. 1*f* shows the opposite side of the cable length compensating device 1 previously described in a perspective view. Through a corresponding dimensioning of the spring 13 mounted between the outer support ring 120 and inner support ring 121 it is possible to influence the torque of the eccentric 10 and thus the axial displacement forces. If the spring 13 is sufficiently strong then also a part of a cable slack of one cable strand can also be pressed across to the other cable strand. A substantially complete compensation of existing cable slack is thereby guaranteed without risking tensions in the system.

By testing sample models of the cable length compensating device according to the invention described above it is known that a rigid bearing of the rotatable base member 12 on a shaft in the event of the window regulator being strained from the output side can lead to resetting movements of the eccentric 10 if this resetting movement is not blocked through a locking element. Simpler and safer however is the construction illustrated in FIGS. 1*a* to 1*c* wherein an overhung bearing was selected with guidance of the support elements 30. The supporting forces initiated there on the outer ring 120 thus engage on a relatively large diameter which provides the rotatable base member 12 with a self-locking action against turning back and thus against a resetting movement of the displaceable base member 11.

Figure 2:
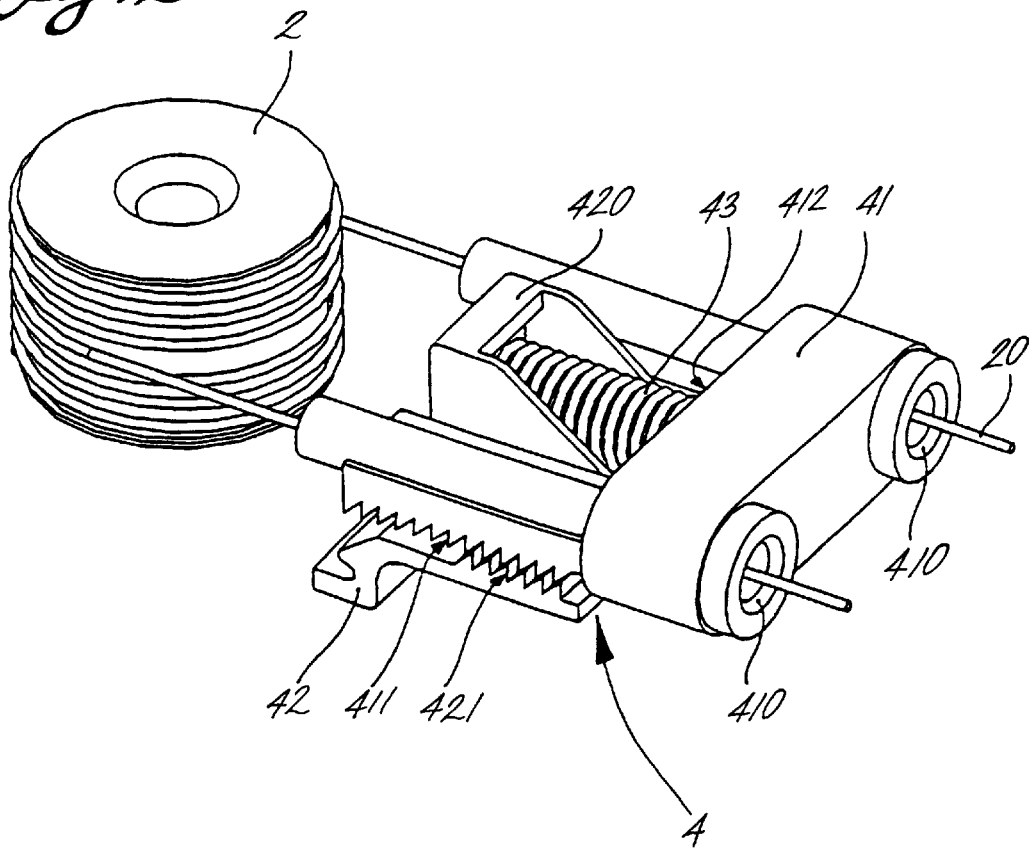
FIG. 2 is a perspective illustration of a cable length compensating device with parallel cable exits and a compression spring for producing the compensating movement as well as saw-tooth detent elements.

A further variation of an embodiment of the inventive principle is shown in FIG. 2, likewise with parallel cable exits of the cable sleeves 410. This cable length compensating device 4 has a one-piece displaceable base member 41 with a compression spring 43 supported on its stop face 412. The opposite end of the compression spring 43 is mounted on a block 420 which is a component part of the immovable base member 42 fixed on the base plate 3. Support forces of the Bowden tubes 200 are introduced from the base member 41 through its teeth 411 which engage with the conforming counter teeth (positive locking elements (421)) of the base member 42 into the base plate of the window regulator.

The positive locking elements 411, 421 are preferably formed like saw-teeth wherein the flat angle points in the direction of the cable length compensation in order to have to apply the smallest possible force for displacing the base member 42. The steep flanks of the positive locking elements 411, 421 should reliably prevent a resetting movement. Compared with the variation described at the beginning with eccentric displacement the cable length compensation can here not take place infinitely but only step-wise corresponding to the geometry of the teeth.

Figure 3A:
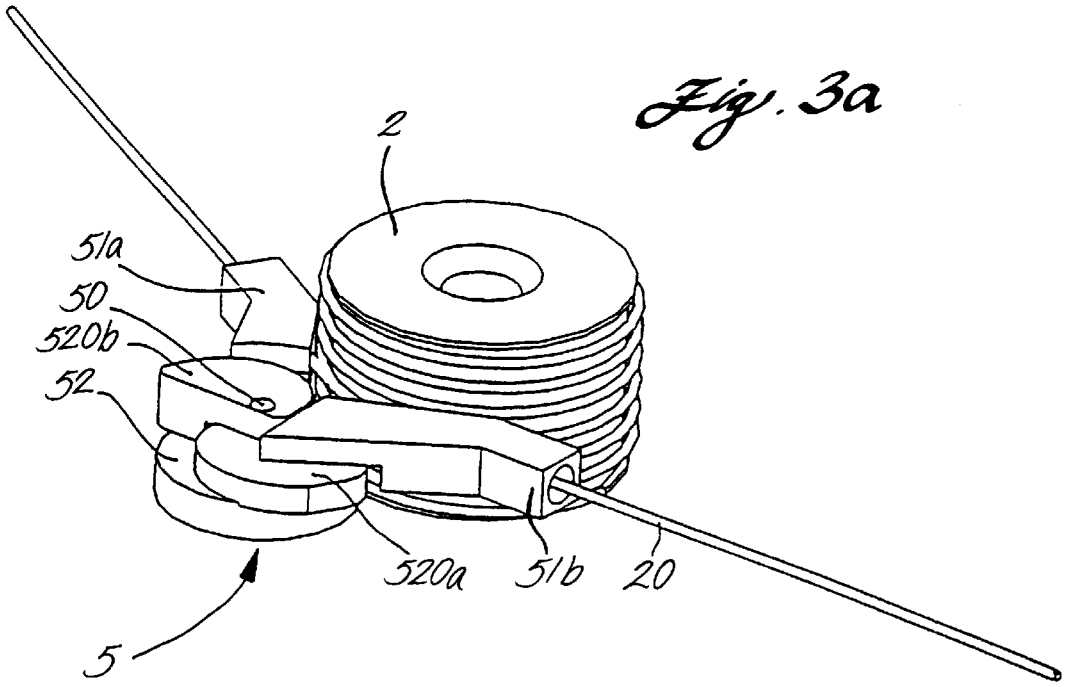
FIG. 3*a* is a perspective illustration of a cable length compensating device with cable exits running at an angle and a two-step eccentric.
Figure 3B:
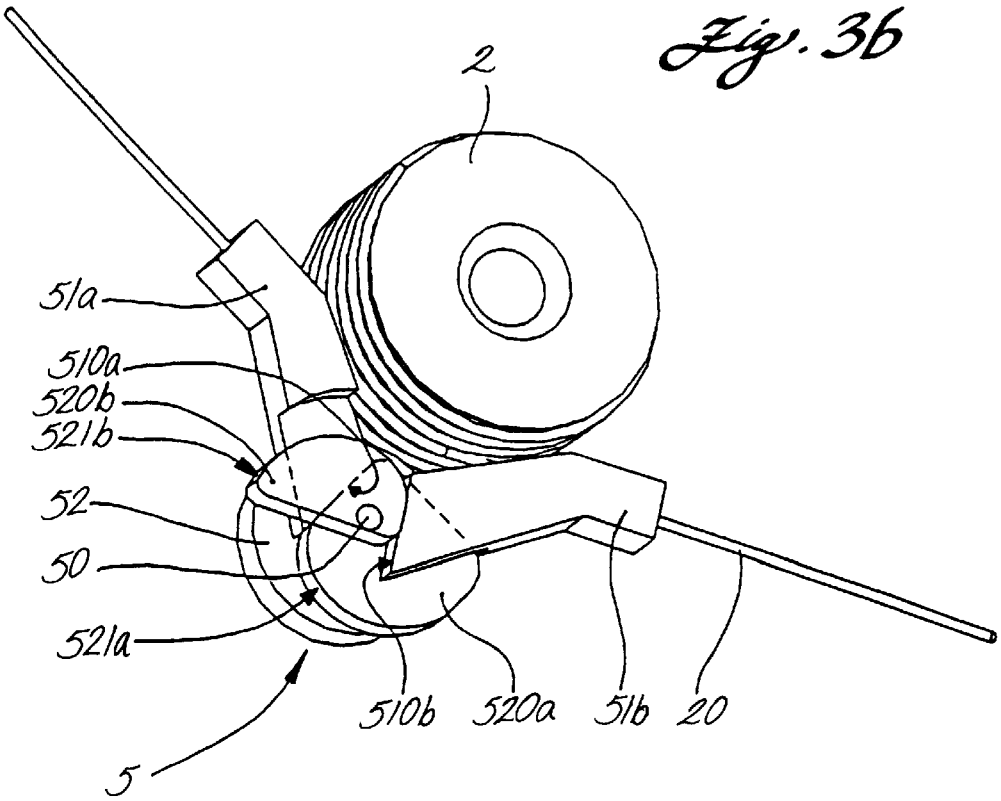
FIG. 3*b* as FIG. 3*a*, but showing the concealed edges of eccentric and stop faces of the cable sleeves.

FIGS. 3*a* and 3*b* show a cable length compensating device 5 for a Bowden tube window regulator with cable exits running at an angle to each other. Here the displaceable base members 51*a*, 51*b* cannot be rigidly connected together, as with the embodiment of FIG. 1.

Each base member 51*a*, 51*b* has a stop face 510*a*, 510*b* which are each allocated to a stop face 521*a* of the eccentric

520*a* and the stop face 521*b* of the eccentric 520*b* respectively. Since the eccentric 520*a*, 520*b* is fixedly connected to the base member 52 and is rotatable in the axis 50, a force coupling also exists here between the two supports of the Bowden tube ends. That is, a cable length compensation is only possible when both cable loops are quasi unstressed.

The perspective diagrammatic illustrations of FIG. 3*a* and 3*b* depict the embodiment of the invention described above in its starting position, just before a rotation of the base member 52 and of the eccentric 520*a*, 520*b* connected therewith has led to a displacement of the base member 51*a*, 51*b* in which the cable sleeves housing the Bowden tube ends are integrated. A spring (not shown) coupled to the rotatable base member 52 produces, in a similar way to the variation of FIG. 1, the torque necessary for the cable length compensation which is required where necessary. All the parts of the cable length compensating device 5 are to be mounted in a suitable manner on a base plate or the like.

Figure 3C:
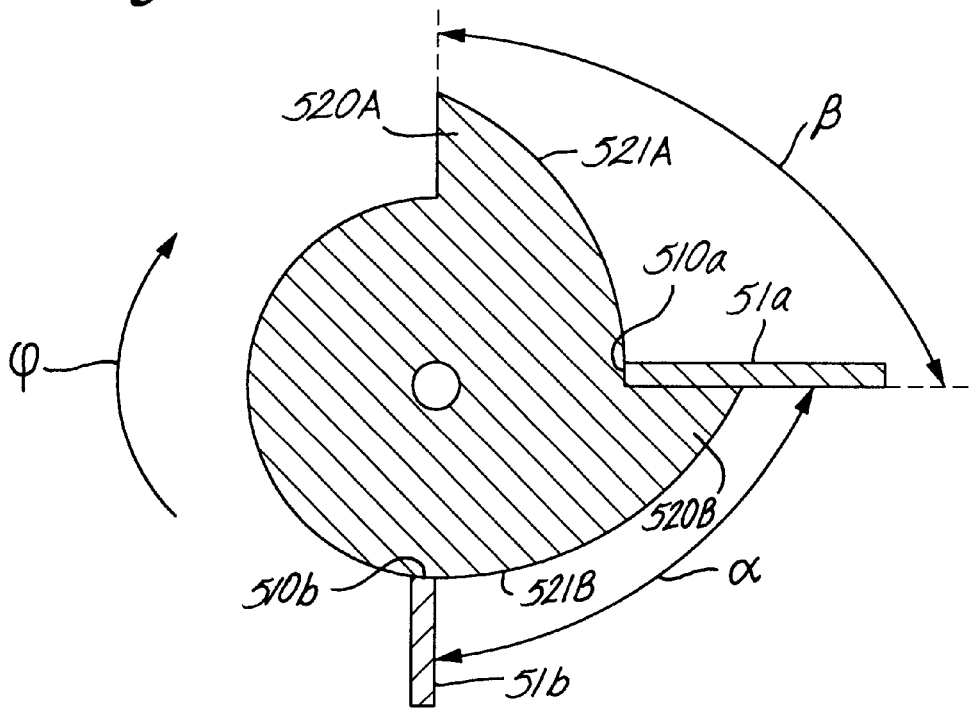
FIG. 3*c* is a diagrammatic illustration of a cable length compensating device wherein the stop faces lie in a common swivel plane.
Figure 3D:
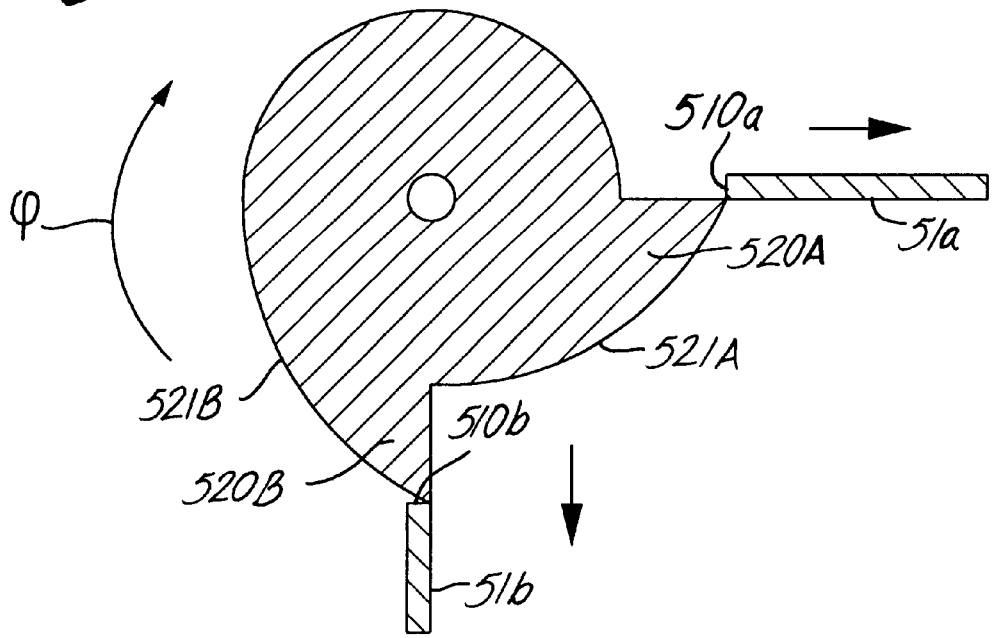
FIG. 3*d* is a diagrammatic illustration of the cable length compensating device of FIG. 3*c* wherein the stop faces are rotated an angle $\alpha$.

The stop faces of the eccentric can lie in one common plane, if the proposed swivel angle of the eccentric is less than the angle included by the cable sleeves. FIG. 3*c* shows an arrangement of the cable sleeves 51*a*, 51*b* including an angle a of 90° and two protruding stop faces 521A and 521B in a common plane. After rotation of the maximum angle of 90° the cable sleeves are at their outmost position as shown in FIG. 3*d*. By turning the eccentric more than 90°, the cable sleeves 51*a*, 51*b* would rebound to the eccentric. Therefore, the proposed swivel angle $\phi$ has to be less than the angle $\alpha$ included by the cable sleeves. If the proposed swivel angle of the eccentric is greater than the angle which the cable sleeves include with each other, the stop faces of the eccentric can lie in different superposed swivel planes.

Figure 3E:
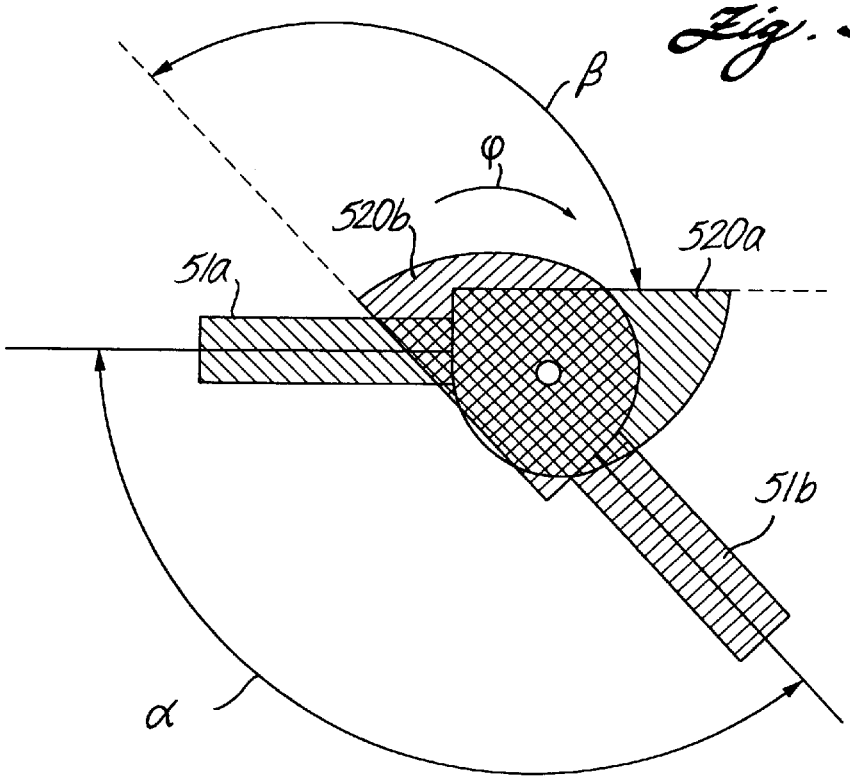
FIG. 3*e* is a diagrammatic illustration of a cable length compensating device wherein the two sections of the eccentric have the same contour.

With reference to FIG. 3*e*, an equal displacement of both of the cable sleeves will be obtained by rotating the two sections (520*a*, 520*b*) which are fixed together. Because of the same contours of the two sections (520*a*, 520*b*), the eccentricity and therefore the displacement of the cable sleeves (51*a*, 51*b*) are identical.

Figure 3F:
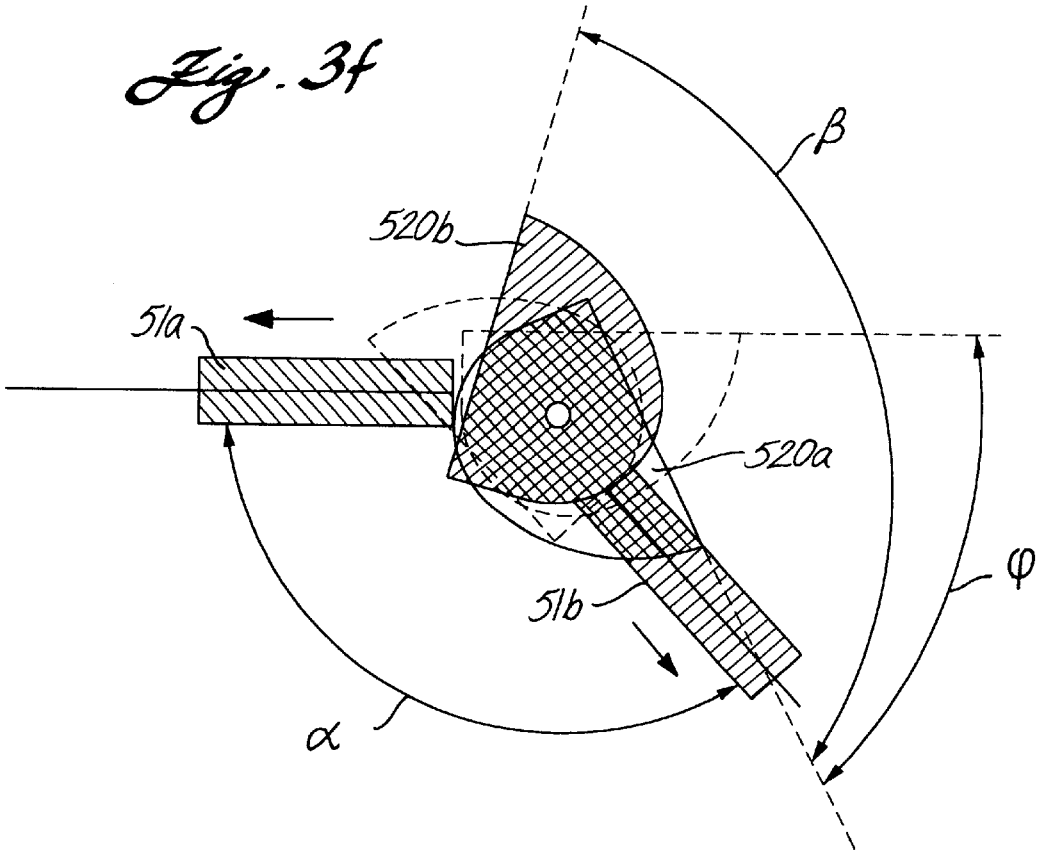
FIG. 3*f* is a diagrammatic illustration of the cable length compensating device of FIG. 3*e* wherein the two sections are rotated an angle $\phi$.

FIG. 3*f* shows the embodiment after rotating about the angle $\phi$. The cable sleeves 51*a*, 51*b* are displaced in the direction indicated by the arrows. The original position of the eccentric is indicated by the dashed line.

Figure 3G:
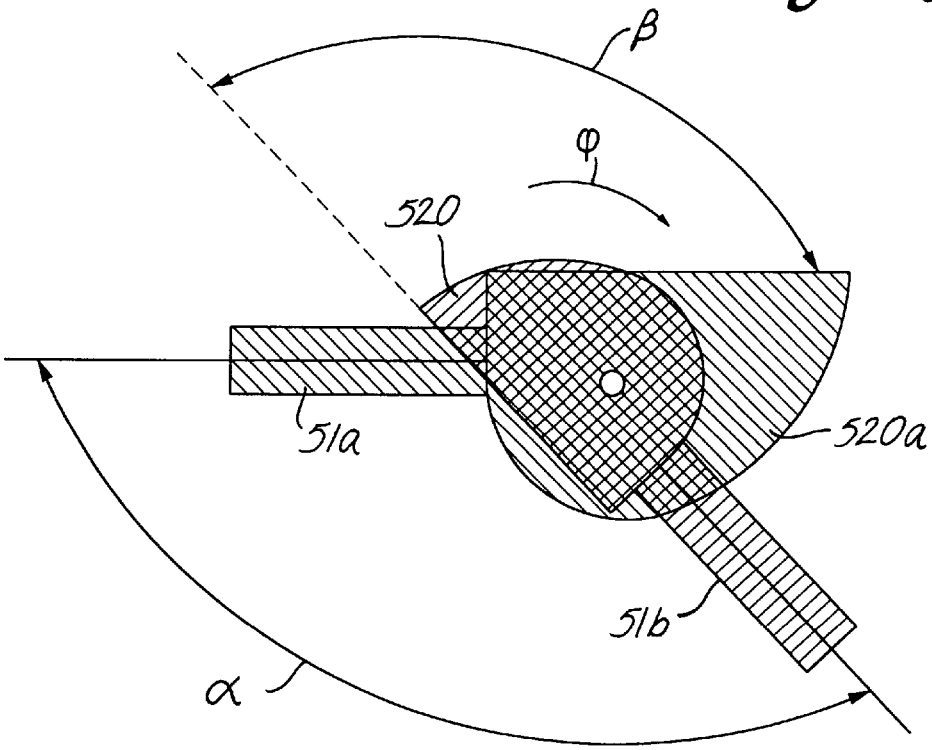
FIG. 3*g* is a diagrammatic illustration of a cable length compensating device wherein the two sections of the eccentric have different contours.
Figure 3H:
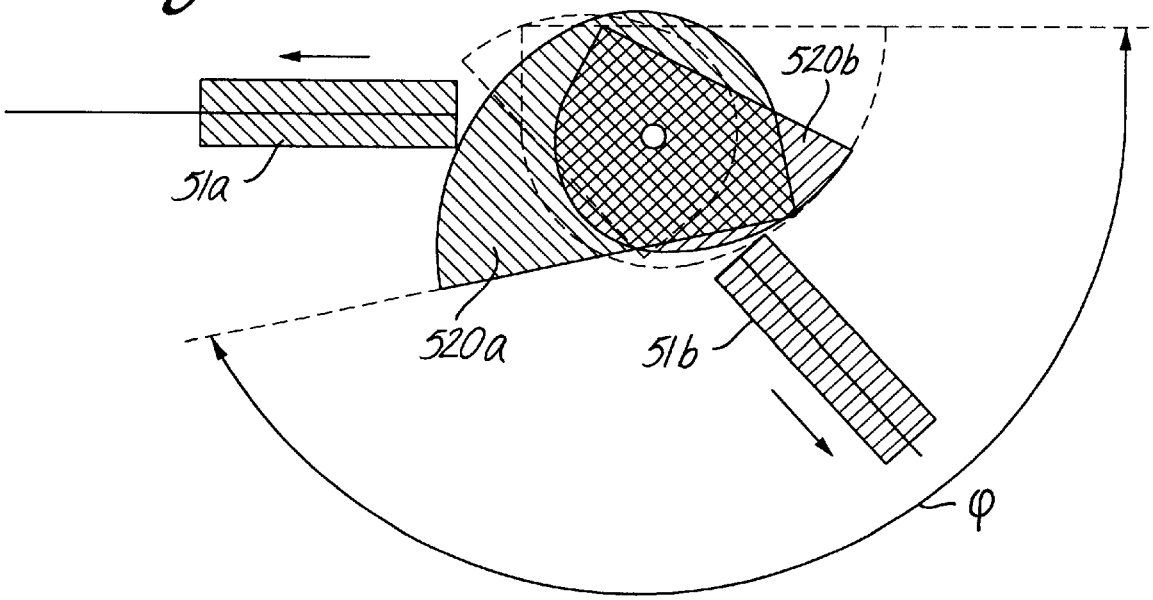
FIG. 3*h* is a diagrammatic illustration of the cable length compensating device of FIG. 3*g* wherein the two sections are rotated an angle $\phi$.

FIG. 3*g* shows an enlarged section 520*a*; but geometrically similar to section 520*b*. It can be clearly seen in FIG. 3*h*, that by rotating the two sections (520*a*, 520*b*) about an angle $\phi$ the displacement of cable sleeve 51*a* is greater than the displacement of cable sleeve 51*b* because of the enlarged eccentricity of the section 520*a*.

Figure 4:
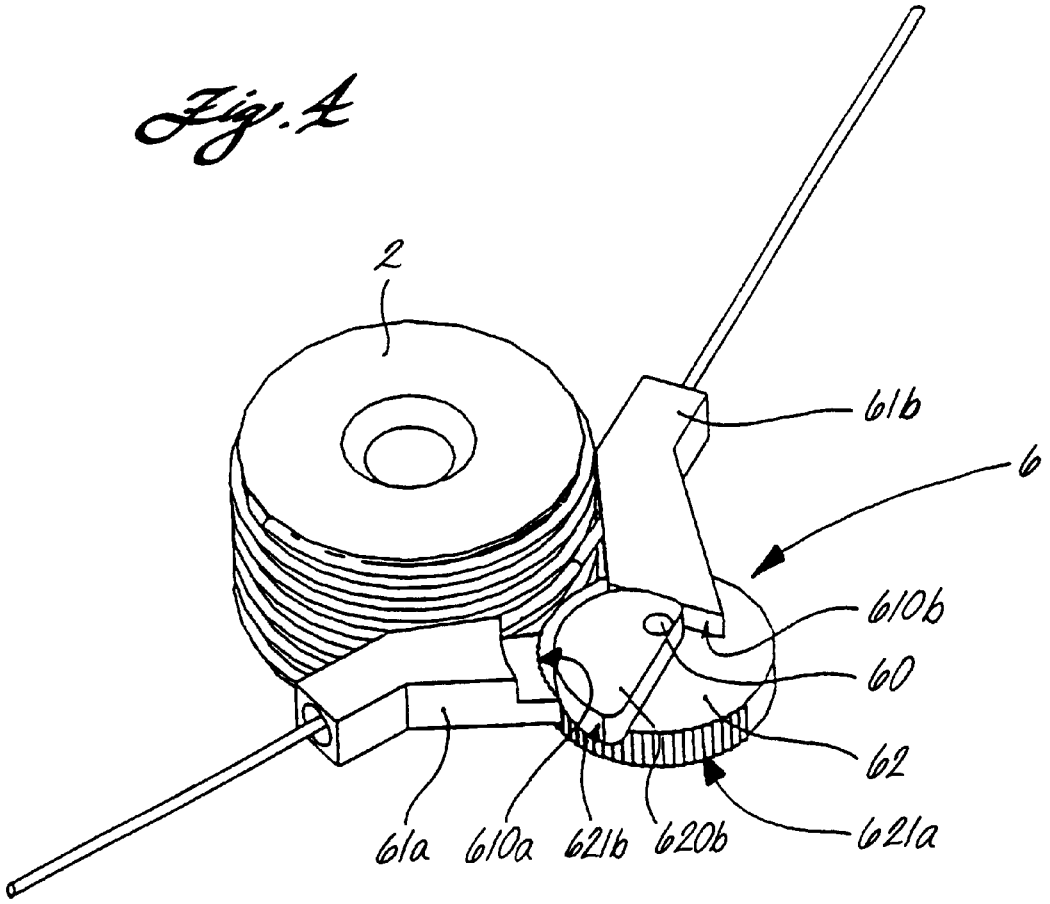
FIG. 4 is a perspective illustration of a cable length compensating device with a circular concentric section of the eccentric.

A further variation of the invention which is substantially similar to that of FIG. 3 however, is shown in FIG. 4. This cable length compensating device 6 uses only one eccentric 620*b* whose stop face 621*b* engages with the stop face 610*b* of an associated displaceable base member 61*b*. The other base member 61*a* is however in connection through its cogged stop face 610*a* with the circular round likewise cogged stop face 621*a* of the base member 62 rotatably mounted in the axis 60. Since the base member 62 and eccentric 620*b* are fixedly connected together, and are preferably made as a one-piece plastic part, the force coupling of the two cable exits is thus again ensured. With a rotary movement of the base member 62 the result is solely for the displaceable base member 61*b*, a setting movement which causes a compensation of the cable slack. The other base member 61*a* only undertakes the already mentioned force coupling and securement of the cable length compensating device 6 against a resetting movement as a result of possible support forces on the side of the Bowden tube acting on the displaceable base member 61*b*.

At this point it should be mentioned that the stop faces 101, 521*a*, 521*b*, 621*b* of the eccentric 10, 520*a*, 520*b*, 620*b* and/or the stop faces 120, 621*a* of the rotatable base member 12, 52, 62 can be formed by a plurality of flat partial faces so that their contour is like a polygon. The self locking of the cable length compensating device 1, 5, 6 against a resetting movement can hereby be easily produced or improved.

We claim:

1. A Bowden tube window regulator, adapted to receive a pair of Bowden tubes, and having a cable with a closed cable loop, which is to be guided over at least two guide pieces mounted along a displacement path of a window pane and is wound up on a cable drum coupled to a drive unit, wherein a cable section of the cable guided between the guide pieces is adapted to support an entrainment member associated with the window pane, the regulator comprising:

a spring-loaded cable length compensating device, the device having a base member comprising a pair of cable sleeves, each of which being adapted to support a load from an end of a respective one of the pair of Bowden tubes;

a locking element associated with both cable sleeves and coupled to the base member; and the locking element being biased to move in a direction to compensate for cable slack when both cable sleeves are substantially unloaded by the Bowden tubes and adapted to move at least one of the cable sleeves and its respective Bowden tube into engagement;

wherein each cable sleeve is displaceable from a set position relative to the locking element to a displaced position relative to the locking element to compensate for cable slack when the locking element is moved in said direction and is prevented from resetting from the displaced position to the set position by the locking element, and wherein the locking element is biased to move in a direction to cause at least one of the cable sleeves to move from the set position to the displaced position only when both cable sleeves are substantially unloaded by the Bowden tubes.

2. The Bowden tube window regulator according to claim 1 wherein the cable length compensating device has a first stop face and the base member is a one-piece displaceable base member in which the cable sleeves as well as the first stop face are integrated, wherein the locking element includes a second stop face, and wherein the first stop face interacts with the second stop face of the locking element to reliably prevent the resetting movement of the displaceable base member.

3. The Bowden tube window regulator according to claim 2 wherein the displaceable base member has a full-length slit extending over an entire length of each cable sleeve and through which the cable can be fitted.

4. The Bowden tube window regulator according to claim 2 wherein one of the first and second stop faces includes a toothed rod having a plurality of teeth aligned in the displacement direction of the base member, and wherein the other of the first and second stop faces includes one or more locking elements which engage in the teeth of the toothed rod.

5. The Bowden tube window regulator according to claim 4 wherein the second stop face is fixed relative to a base plate and is formed in one-piece on a housing of the cable drum.

6. The Bowden tube window regulator according to claim 1 wherein the locking element is a rotatably mounted eccentric which is connected to a pretensioned spring.

7. The Bowden tube window regulator according to claim 6 wherein the cable length compensating device has a first stop face and the base member is a one-piece displaceable base member in which the cable sleeves as well as the first stop face are integrated, and wherein the rotatably mounted eccentric has a rotary axis that is to be mounted locally fixed relative to the cable drum, and is in engagement with the first stop face, which is molded on the one-piece displaceable base member of the cable length compensating device.

8. The Bowden tube window regulator according to claim 6 wherein the rotatably mounted eccentric has a rotary axis that is to be mounted locally fixed relative to the cable drum, and wherein the eccentric has two sections with separate stop faces, each of which is in engagement with a stop face of a respective one of the pair of cable sleeves, and wherein the cable sleeves extend at an angle to each other.

9. The Bowden tube window regulator according to claim 8 wherein the separate stop faces lie in a common swivel plane of the rotatable mounted eccentric.

10. The Bowden tube window regulator of claim 9, wherein the maximum swivel angle provided is smaller than the angle which the axes of the cable sleeves include with each other.

11. The Bowden tube window regulator according to claim 8 wherein the separate stop faces lie in different superposed swivel planes of the rotatable mounted eccentric.

12. The Bowden tube window regulator of claim 11, wherein the maximum swivel angle provided is greater than the angle which the axes of the cable sleeves include with each other.

13. The Bowden tube window regulator according to claim 8 wherein the two sections of the rotatable mounted eccentric have a substantially identical contour and include the same angle with each other as the cable sleeves so that in the event of play and rotation of the eccentric equal-length play compensating movements of the cable sleeves are produced.

14. The Bowden tube window regulator according to claim 8 wherein the two sections of the rotatable mounted eccentric have substantially different contours so that with the appearance of play and rotation of the eccentric, unequal length play compensation movements of the cable sleeves are produced.

15. The Bowden tube window regulator of claim 14, wherein the eccentrics are geometrically similar.

16. The Bowden tube window regulator according to claim 8 wherein one of the sections of the rotatably mounted eccentric has a circular shaped contour with a position concentric relative to the rotary axis of the other section of the rotatable mounted eccentric, and to which one of the cable sleeves is allocated, and wherein the other section of the eccentric has an eccentric stop face and the other cable sleeve is associated with the eccentric stop face of the other section of the eccentric so that with the appearance of play and rotation of the eccentric only the second cable sleeve executes a play compensating movement.

17. The Bowden tube window regulator according to claim 16 wherein the circular shaped contour of the rotatably mounted eccentric supports positive locking elements which at least with strain on the one cable sleeve, engage with conforming positive locking elements of the one sleeve.

18. The Bowden tube window regulator according to claim 6 wherein the rotatably mounted eccentric comprises a polygonal outer contour.

19. The Bowden tube window regulator of claim 6, wherein the spring is one of a coil or spiral spring.

* * * * *